US005788616A

United States Patent [19]

Polidi

[11] Patent Number: 5,788,616

[45] Date of Patent: Aug. 4, 1998

[54] MECHANICAL WEIGHTLIFTING MACHINE

[76] Inventor: Richard Polidi, 170 W. End Ave., New York, N.Y. 10023

[21] Appl. No.: 905,461

[22] Filed: Aug. 4, 1997

[51] Int. Cl.[6] ..... A63B 21/078

[52] U.S. Cl. ..... 482/104; 482/94; 482/97

[58] Field of Search ..... 482/93, 94, 97, 482/104, 106, 108

[56] References Cited

U.S. PATENT DOCUMENTS

| | | | |
|---|---|---|---|
| 458,382 | 8/1891 | Zander | 482/97 |
| 3,573,865 | 4/1971 | Annas . | |
| 4,226,414 | 10/1980 | Coffaro et al. | 482/97 |
| 4,253,662 | 3/1981 | Podolak . | |
| 4,471,956 | 9/1984 | Marlo . | |
| 4,566,690 | 1/1986 | Schook . | |
| 4,621,810 | 11/1986 | Cummins . | |
| 4,634,118 | 1/1987 | Jensen . | |
| 4,650,185 | 3/1987 | Cartwright . | |
| 4,765,613 | 8/1988 | Voris . | |
| 4,773,642 | 9/1988 | Cruz . | |
| 4,799,672 | 1/1989 | Barrett . | |
| 4,807,875 | 2/1989 | Tankski . | |
| 4,949,959 | 8/1990 | Stevens . | |
| 4,955,604 | 9/1990 | Pogue . | |
| 4,973,050 | 11/1990 | Santoro . | |
| 4,974,835 | 12/1990 | Klink . | |
| 5,310,394 | 5/1994 | Kallios . | |
| 5,314,394 | 5/1994 | Ronan . | |
| 5,346,448 | 9/1994 | Sollo . | |

*Primary Examiner*—Richard J. Apley
*Assistant Examiner*—John Mulcahy
*Attorney, Agent, or Firm*—Bielen, Peterson & Lampe

[57] ABSTRACT

A mechanical weightlifting machine for use with free weights in which the machine has a support structure with an elevated pivot having a pivot axis and an articulating mechanism engaging the pivot. The articulating mechanism having projecting lever arms connected to the pivot with depending rod members to which the free weights are connected, the articulating mechanism having a counterweight on a lever arm with one end connected to the support structure and another having a link connected to a displaceable connection member on the articulating mechanism, the machine having a user controlled actuator to displace the displaceable connection member to vary the effective weight applied to or removed from the free weights.

13 Claims, 3 Drawing Sheets

MECHANICAL WEIGHTLIFTING MACHINE

BACKGROUND OF THE INVENTION

This invention relates to a mechanical weightlifting machine that serves functions which in the past have required a human spotter to be present. The machine performs these functions with precision and consistency exceeding those of a human spotter.

When an exerciser employs free weights ultimately to build or tone muscle tissue, a human spotter serves two primary functions. The first function is to act as a "safety net " in order to prevent injury to a weight user. The second function is to prolong the resistance by providing just enough aid to a weight user to allow this user to continue the repetitions in a set beyond the point that the user could no longer lift the weight without assistance. Completing these additional repetitions is important to improve muscle stamina or increase muscle mass.

This invention relates to a mechanical weightlifting machine that provides the functions of a human spotter in a user controlled apparatus. Various apparati have been devised to assist exercisers who prefer to train with dumbbells, barbells, or other "free weights." These apparati range from simple benches equipped with supports for the bar of a barbell to user controlled machines that connect to a free weight and assist a user when activated. Almost all of the latter type of apparatus fall into two distinct categories. The first category encompasses a "forklift" mechanism that relies on an electric motor to raise a cable that is fastened at one end to free weights used for exercise. Prior attempts have incorporated a clutch mechanism into the connection between motor and cable to vary the assistance. The second category relies on hydraulic or pneumatic devices instead to vary the assistance to the exerciser. A main disadvantage of machines from either category is that they usually require cables which through a pulley apparatus link the free weights to an assisting mechanism. Although cables create a smooth motion as the weight is lowered, they often cause abrupt movements as the weight is raised. A goal of the invention disclosed herein is to eliminate abrupt motions by incorporating its mechanism without cables. A second disadvantage of prior machines is that they often restrict the exerciser's range of motion as he attempts to raise and lower the weights. Examples of these machines are ones on which the free weights are connected to tracks and ones that simulate exercises with free weights. Without a full range of motion, the exerciser no longer must work to balance the free weight throughout the exercise while maintaining proper form. This balancing act is an essential advantage of free weights for promoting muscle growth. For this reason, a second goal of the machine disclosed herein is not to restrict the exerciser's range of motion. A third goal of the machine is to function in a readily apparent manner by a mechanism that is both visible and obvious.

The mechanical weightlifting machine of this invention is used in conjunction with free weights which are generally provided separately. The weightlifting machine is used both with and without a bench and is designed to expand the type of training available to a weightlifter. During power sets with free weights, the machine can quickly change the effective load of the free weights between sets, meanwhile eliminating the need for the user to leave his immediate vicinity to retrieve another set of dumbbells or to add or remove weight plates from a barbell. In a recreational weightlifting facility, another advantage is not being affected when dumbbells of the desired weight unavailable because they are being occupied. In a physical therapy facility, an advantage is the linear variability of the effective load; a patient would no longer be limited to three-pound or five-pound increments when one-half pound increments are desired. In addition, if a person has access to only a single set of dumbbells rather than multiple sets of various weights, the machine along with only a single set of dumbbells can simulate multiple weights to the exerciser to add versatility to his training. Other advantages from the mechanical weightlifting machine include those from its ability to alter the exercise weight while the exercise is in progress. They also include those from its capacity to "catch" weights before they reach the ground and then suspend these weights until the user commences the following set.

These and other advantages of the foregoing invention will be described in greater detail in the Summary of the Invention and the Detailed Description of the Preferred Embodiment.

SUMMARY OF THE INVENTION

This invention relates to an exercise machine and in particular to a mechanical weightlifting machine that provides assistance during the exercise activity. The weightlifting machine is designed to enable a user to add or subtract weight instantly from the initially selected weight whether or not the exercise is in progress. First, this enables rapid power or "pyramid" sets where incremental weight is added or subtracted during or after each set of repetitions and fatigue sets where incremental weight is subtracted during a set as the exerciser becomes exhausted and unable to complete a repetition with the full initial weight. Second, this allows the user to assume a lower risk of injury while exercising with weights because the user no longer sacrifices correct form in order to complete the final repetitions of a set. Instead, the user has full control over the amount of aid that the machine provides and can lower the exercise weight during the set to complete these repetitions properly. Third, this enables negative resistance training, which in this case requires the machine to decrease the amount of weight before it is lifted and then increase the amount of weight before it is lowered. The machine is designed to provide these advantages in common exercises including, but not limited to, bicep curls and shoulder presses.

Adjustment of the lever arm is accomplished by a remote control incorporated into a foot control. In this manner, the exerciser controls the addition or subtraction of weight from the weight with which he is exercising. Alternately, adjustment of the lever arm may be accomplished by a hand dial to allow a person other than the exerciser to control the amount of weight that the exerciser is lifting. This feature is better suited for physical therapy or similar applications in which a "trainer," the person who designs and oversees the exerciser's regimen, wishes to regulate more precisely the amount of force that the exerciser must exert at various points throughout a single exercise. These and other features of the invention will become apparent from the detailed description.

DETAILED DESCRIPTION OF THE PREFERRED EMBODIMENTS

Figure 1:
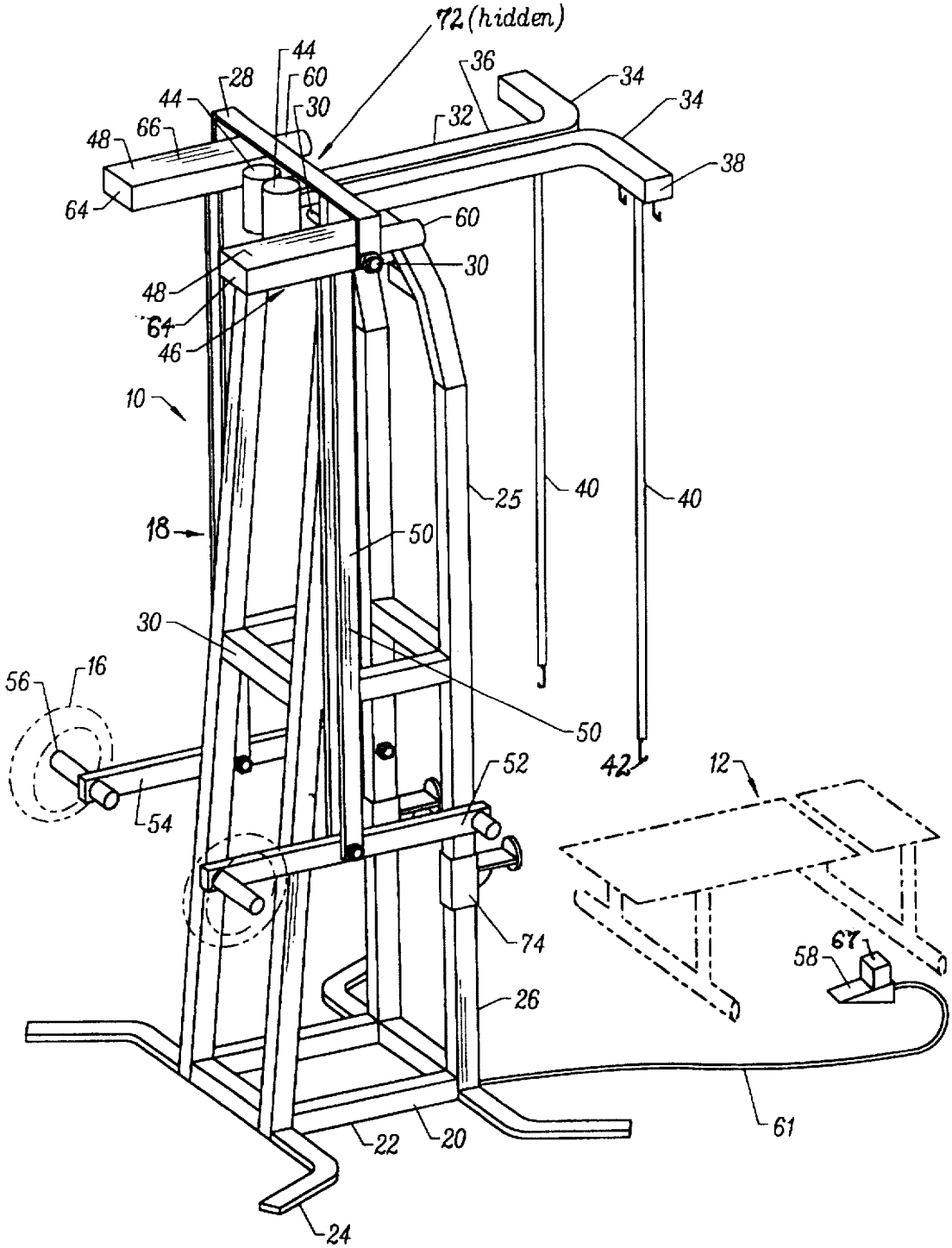
FIG. 1 Is a perspective view of the weightlifting machine of this invention.

The mechanical weightlifting machine of this invention, designated generally by the reference numeral 10, functions as a mechanical spotter. The mechanical weightlifting machine 10 or spotter is used in many routines with a conventional bench 12 shown in phantom in FIG. 1. Additionally, the mechanical weightlifting machine, hereinafter the spotter 10, is used with weights in the form of conventional disks or plates 16, two of which are shown in phantom in FIG. 1.

The spotter 10 is constructed with a support frame 18 having a base 20 formed by interconnected box tube members 22 and wing-like stabilizer members 24. The support frame 18 also has a vertical support structure 25 formed of substantially vertical box tube members 26 having a generally rectangular or pyramidal structure with an apex cross beam 28. Box tube members 30 located approximately mid-way on the vertical support 24 provide the necessary bracing to impart rigidity to the support frame for the range of uses and weights for which the apparatus was contemplated. The box tube members are joined by welding or bolting and are customarily chrome or nickel plated for appearance.

The cross beam 28 supports a pivot shaft 30 to which an articulating mechanism 32 is attached for pivotal movement. The articulating mechanism 32 preferably has two independently articulating structures 34 allowing the mechanical spotter 10 to be selectively used with dumbbells as well as a barbell. Furthermore, each articulating structure can be used alone without operation of the other structure. The articulating structures 34 each include a cantilever arm 36 with spaced distal ends 38. From the distal ends by way of universal joints are suspended rods 40 with ends 42 that connect to a dumbbell or a barbell (not shown). The cantilever arms 36 are designed to raise 30° from the horizontal and lower 30° from the horizontal during exercise repetitions. This provides approximately a 30 inch displacement at the distal ends 38 of the arms 36.

The arms 36 extend a short distance beyond the pivot shaft 30 and are connected to counter weights 44. The counter weights 44 are sized to balance the articulating structures 34 at a predefined neutral position, so that a user will not experience any resistance in raising or lowering his free weights that are connected to the rods 40 during the initiation of his exercise unless otherwise desired. The arms 36 of the articulating structures are fixed to the shaft 30 such that rotation of the shaft by the arms 36 also rotates a connected adjustment mechanism 46 with a lever arm 48 having an adjustable effective length. The lever arms 48 are each connected by elongated vertical links 50 to a fixed length lever arm 52 with a distal end 54 equipped with weight spindles 56 for the optional addition of weight plates 16.

The weight spindle 56 provides for placement of one or more weights 16 to increase the rate of weight adjustment on operation of a remote foot control 58 (or head control, not shown). The foot control 58 is electronically connected to a pair of drive motors 60 by a cord 61. The drive motors 60 are connected to a displacement device 64 under a shroud 66 in FIG. 1. The foot control 58 has a toe strap 67 to permit bi-directional control over displacement of the displacer nut device 64. For example, a lift action by the user's foot lightens the load and a down pressure increases the load. The foot control 58 has a reset that returns each displacement device 64 to its neutral position.

Figure 2:
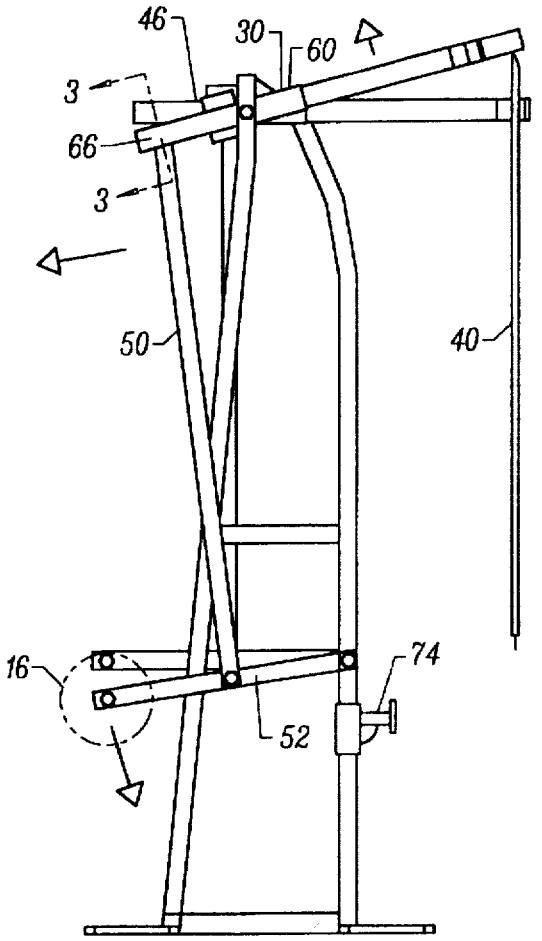
FIG. 2 Is a side elevation view of the weightlifting machine of FIG. 1 with one arm member displaced from the other.
Figure 3:
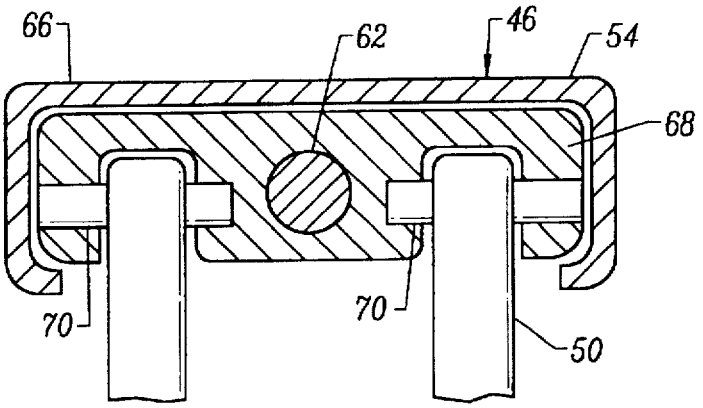
FIG. 3 Is an enlarged cross sectional view taken on the line 3.3 in FIG. 2.

Referring to FIGS. 2 and 3, the adjustment mechanism 46 when activated will displace the effective pivotal connection of the elongated links 50 from a position proximate the axis of the shaft 30 to an axis displaced from the shaft. For example, in FIG. 2, the pivot connection of the links 50 is moved toward the distal end of the shroud 66. Referring to FIG. 3, the adjustment mechanism 46 includes the outer shroud 66 that forms a housing and guide for threaded block 68 that is displaced by the ball screw shaft 62 during rotation by the drive motor 60. The interconnecting links 50 are thereby displaced from the neutral position so that the fulcrum effect of the weights 16 on the fixed lever arm 52 translate to a raising force at the rods 40. The elongated links 50 are connected to the threaded carriage or block 68 by pins 70 which define the pivot point of the links 50.

If it is desired that additional weight be added to the free weights handled by the user, the block 68 is displaced toward the axis of the shaft 30. The added weights 16 and the counter weights 44 reach a point that they no longer offset the weight of the arms 36, and, the differential is thereby added to the effective weight of the user through the rods 40. To limit the downward swing of the arms 36, the support frame 18 is equipped with stops 72 preventing a downward angle exceeding 45°. The foot control 58 provides a remote control operable by the user during exercise to adjust the effective weight of the user's free weights connected to the machine 10.

Figure 4:
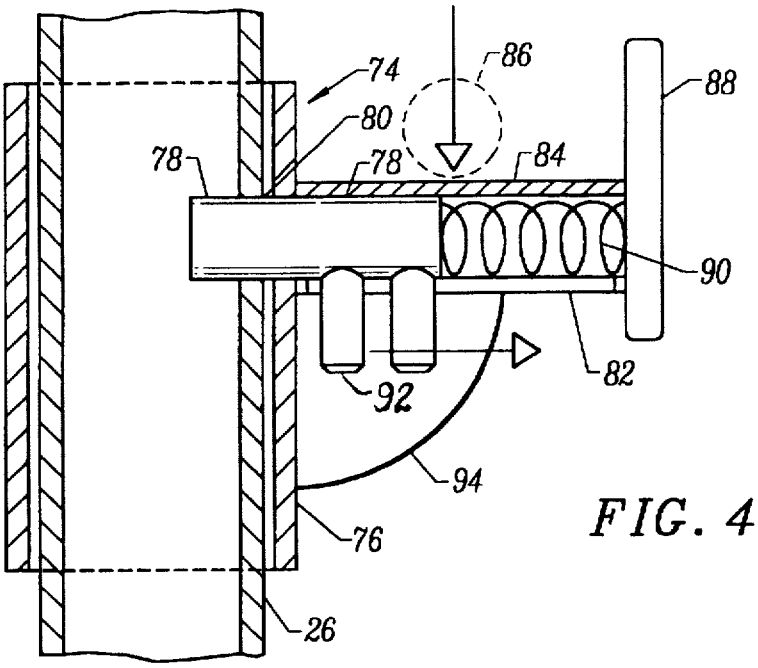
FIG. 4 Is an enlarged cross sectional view of a weight rest on the weightlifting machine of FIG. 1.

The support frame 18 includes a pair of weight rests 74 mounted to the vertical members 26 on the side of the support structure from which the arms 36 extend. The rests 74 are shown in greater detail in the enlarged view of FIG. 4. The rests 74 have a collar 76 that encircles the vertical members 26 and a retractable pin 78 that engages one of a series of holes 80 allowing vertical adjustment of the rest 74. A weight support 82 is connected to the collar 76 and projects from the collar 76 to provide a flat seat 84 for the bar 86 of a barbell or dumbbell, shown in phantom. An end stop 88 prevents the bar from rolling off the seat 84 and additionally provides a blunt end for inadvertent contact. The pin 78 is retracted against a compression spring 90 by a trigger 92 connected to the pin 78 and protected by a guard 94.

Figure 5:
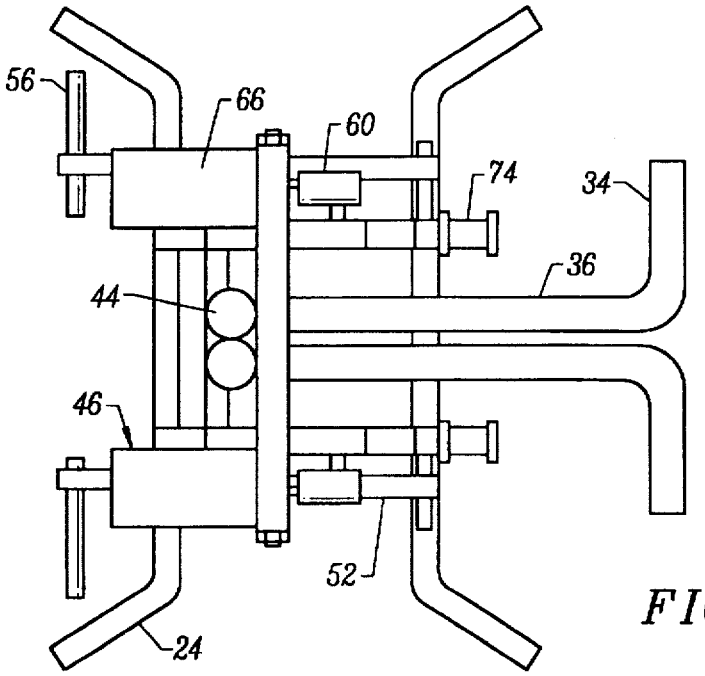
FIG. 5 Is a top view of the weightlifting machine of FIG. 1.

The arrangement of the adjustment mechanism 46 to the cantilever arm 36 in the articulating structures 34 is shown in the top view of the weightlifting machine 10 in FIG. 5.

Figure 6:
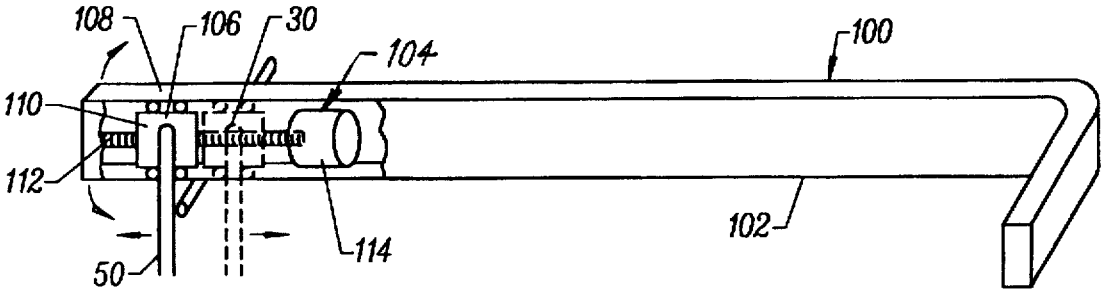
FIG. 6 Is a schematic view of an alternate displacement unit for the weightlifter machine of FIG. 1.

Alternately, the cantilever arm 36 and the adjustment mechanism 46 can be combined into a single articulating unit as shown in the alternate embodiment of adjustment mechanism in FIG. 6.

Referring to FIG. 6, the alternate embodiment, of the articulating unit, designated by the reference numeral 100 is shown schematically. With the exception of the combined cantilever arm and remainder adjustment mechanism, forming the integrated articulating unit 100, the remainder of the apparatus is the same as that of the previously described embodiment. The cantilever arm 102 is a hollow box number 104 that provides a housing for the adjustment mechanism 106. The cantilever arms 102 are spaced to allow connection of the elongated vertical links 50 to the adjustment mechanism 106. An extension 108 of the cantilevered arms 102 on the opposite side of the pivot shaft 30, forms a housing for the moveable internal carriage. The carriage 110 is threadable connected to a ball screw 112 in a manner similar to that shown in FIG. 3. A drive motor 114 (one shown in FIG. 6) is housed within the arm 102 and is connected to the adjustment screw 112 for displacement of the carriage 110 on activation of the motor in a forward or reverse direction.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A mechanical weightlifting machine for use with free weights comprising:

a support structure having an elevated pivot with a pivot axis;

an articulating mechanism engaging the pivot having at least one articulating structure with a projecting lever arm connected to the pivot for limited pivot about the axis of the pivot, wherein the projecting lever arm has a distal end on one side of the pivot with a connection device having a depending link member with an end having means for engaging a free weight, and, wherein the articulating structure has an adjustment mechanism with a displaceable connection device having a counterweight locatable on the opposite side of the pivot;

actuation means engaging the connection device for displacing the connection device relative to the axis of the pivot wherein the leverage of the connected counterweight directed to the projecting lever arm is adjusted; and, a user control remote from the adjustment mechanism with control means for actuating the adjustment mechanism and displacing the connection device.

2. The mechanical weightlifting machine of claim 1 wherein the actuation means has displacement means for displacing the connection device within a limited range including a first location on the opposite side of the pivot from the projecting lever arm to a second location on the same side of the pivot from the projecting lever arm.

3. The mechanical weightlifting machine of claim 1 wherein the counterweight is connected to the connection device.

4. The mechanical weightlifting machine of claim 3 wherein the connection device has a depending link with a distal end and a second lever arm having a first pivotal connection with the distal end of the depending link and a second pivotal connection with the support structure, wherein the depending link and the second lever arm comprise the counterweight.

5. The mechanical weightlifting machine of claim 4 wherein the second lever arm has support means for supporting added counterweights to the second lever arm.

6. The mechanical weightlifting machine of claim 5 wherein the second lever arm has a first pivot end pivotally connected to the support structure and a second distal end, wherein the support means is located at the second distal end of the second lever arm.

7. The mechanical weightlifting machine of claim 1 wherein the depending link member is rigid having a universal joint connection to the distal end of the projecting lever arm.

8. The mechanical weightlifting machine of claim 1 wherein the actuation means includes a screw threadably engaging the connection device.

9. The mechanical weightlifting machine of claim 8 wherein the actuation means includes a drive means for rotating the screw.

10. The mechanical weightlifting machine of claim 9 wherein the drive means comprises a reversible electric motor.

11. The mechanical weightlifting machine of claim 1 wherein the user control comprises a remote control device electronically connected to the electric drive means.

12. The mechanical weightlifting machine of claim 11 wherein the control means comprises an electronic controller circuitry associated with the electric motor for controlling the motor in response to control signals form the remote controller.

13. The mechanical weightlifting machine of claim 1 wherein the articulating mechanism has two articulating structures each structure having an adjustment mechanism with an independently displaceable connection device.

* * * * *